US008147212B2

(12) United States Patent
Lawes

(10) Patent No.: US 8,147,212 B2
(45) Date of Patent: Apr. 3, 2012

(54) WAVE DRIVEN AIR COMPRESSOR

(76) Inventor: Roland Lawes, Santigo (PA)

( * ) Notice: Subject to any disclaimer, the term of this patent is extended or adjusted under 35 U.S.C. 154(b) by 239 days.

(21) Appl. No.: 12/647,024

(22) Filed: Dec. 24, 2009

(65) Prior Publication Data

US 2011/0158827 A1 Jun. 30, 2011

(51) Int. Cl.
*F04F 99/00* (2009.01)

(52) U.S. Cl. ..... 417/100; 417/96; 417/98

(58) Field of Classification Search ..... 417/92, 417/93, 95, 96, 98, 100, 61, 337, 330, 331, 417/333, 51–53; 60/398, 495, 497
See application file for complete search history.

(56) References Cited

U.S. PATENT DOCUMENTS 547,338 A * 10/1895 Duffy ..... 417/333
1,623,341 A * 4/1927 Hare ..... 417/333
1,757,166 A 5/1930 Brady
3,758,083 A * 9/1973 Palmer ..... 261/25
3,879,950 A 4/1975 Yamada
4,013,379 A 3/1977 Bolding
4,077,213 A 3/1978 Hagen
4,078,871 A 3/1978 Perkins, Jr.
4,257,751 A * 3/1981 Kofahl ..... 417/394
4,326,840 A * 4/1982 Hicks et al. ..... 417/331
4,418,286 A 11/1983 Scott
4,613,287 A 9/1986 Hambley
4,781,023 A 11/1988 Gordon
5,052,902 A * 10/1991 Labrador ..... 417/330
5,094,595 A * 3/1992 Labrador ..... 417/332
5,340,283 A * 8/1994 Nagata ..... 417/118
5,701,740 A * 12/1997 Tveter ..... 60/505
6,575,712 B1 * 6/2003 Slavchev ..... 417/331
6,956,299 B2 10/2005 Molina et al.
2007/0039878 A1 * 2/2007 Roberts et al. ..... 210/605

OTHER PUBLICATIONS

Oyster—the world's largest working hydroelectric wave device, Jeff Salton, Egogizmo, Nov. 26, 2009.

* cited by examiner

*Primary Examiner* — Devon C Kramer
*Assistant Examiner* — Thomas Fink
(74) *Attorney, Agent, or Firm* — Clifford Kraft

(57) ABSTRACT

A vertical wave powered air compressor where different parts of the structure are at different depths (and hence static pressures). A plurality of compression stages are stacked one below the other. Each level has two or more chambers. The chambers have a series of check valves or water seals between them. Each passing wave raises and lowers the entire stack. As the stack moves downward, increased water pressure causes water to enter the first chambers at each level compressing the air inside. As the stack returns upward, the decreased water pressure causes water to leave the first chambers allowing the air therein to expand. However, the check valves prevent the air in the second chambers from expanding or escaping back into the first chambers. Another set of check valves allow the air in the second chambers, as it expands, to be forced downward into the next lower first chamber. With each upward and downward movement of the stack, as waves pass, a quantity of air moves downward from stage to stage until, at the bottom, the lowest stage discharges compressed air into a return pipe.

20 Claims, 7 Drawing Sheets

SECTION X-X OF FIG. 2

SECTION Y-Y OF FIG. 6

WAVE DRIVEN AIR COMPRESSOR

BACKGROUND

1. Field of the Invention

The present invention relates generally to capturing energy from waves on bodies of water such as the ocean and more particularly to an apparatus and method for compressing air using power from waves.

2. Description of the Prior Art

A typical ocean wave in deep water is around 9 feet high with a period of around 8 seconds. In some areas, at some times, 30 foot waves are not uncommon. It is well known that such waves carry considerable energy. For centuries, man has desired to somehow capture and make use of this energy as a source of power.

Numerous attempts have been made in the art to capture the energy inherent in ocean waves (or waves on other bodies of water). In U.S. Pat. No. 4,418,286 Scott teaches a counterbalance to generate electricity from waves. In U.S. Pat. No. 4,781,023 Gordon teaches a floating raft that moves up and down with respect to the ocean bottom. In U.S. Pat. No. 4,077,213 Hagen teaches a system of different size floats. In U.S. Pat. No. 3,879,950, Yamada teaches using compressed air and superheated steam as a means of storing wave energy. In U.S. Pat. No. 1,757,166 Brady uses floats and pontoons to capture wave energy. In U.S. Pat. No. 6,956,299, Molina et al. use floating bodies to produce pneumatic and/or hydraulic pressure. Labrador, in U.S. Pat. No. 5,094,595 uses horizontal pistons to compress air from waves. Hambley in U.S. Pat. No. 4,613,287 uses two or more stages mounted on a horizontal shaft. Bolding in U.S. Pat. No. 4,013,379 uses a compressor piston which is sea water itself that can be attached to a sea wall or the like. Compression comes from the horizontally moving wave mass of incoming waves. Bolding does not discuss interference from ebbing waves that reflect from the device. Perkins Jr. in U.S. Pat. No. 4,078,871 also uses horizontal momentum directed to travel up a ramp.

None of the above-mentioned inventions take advantage of static water pressure as a result of depth as well as wave motion to compress air. Also, none of them can be submerged conveniently to weather storms or high seas. It would be especially advantageous to have a wave-driven system that compresses air that captures energy from ocean waves using static pressure from depth, and which can be easily submerged to weather high sea and storms.

SUMMARY OF THE INVENTION

The present invention is directed toward a wave powered air compressor that is structured vertically so that different parts of the structure are at different depths (and hence static pressures). A plurality of compression stages are stacked one below the other. Each stage generally has two or more chambers. A compressed air return pipe can run up the center of the stack also acting as a structural member to support the stack. The chambers also have a series of check valves or water seals between them. Each passing wave raises and lowers the entire stack. As the stack moves downward, increased water pressure causes water to enter the first chambers at each level compressing the air therein. Some of the compressed air passes through the check valves into the second chambers. The air in the first chambers at each depth will be at a pressure equal to the water pressure at that depth. As the stack returns upward, the decreased water pressure causes water to leave the first chambers allowing the air therein to expand. However, the check valves prevent the air in the second chambers from expanding or escaping back into the first chambers. Another set of check valves allow the air in the second chambers, as it expands, to be forced downward into the next lower first chamber when the stack has risen high enough so that pressure in a second chamber exceeds the pressure in the next lower first chamber. With each upward and downward movement of the stack, as waves pass, a quantity of air moves downward from stage to stage until, at the bottom, the lowest stage discharges into the central return pipe. Air pressure in this return pipe will be equal to the water pressure at the lowest stage. Compressed air can be continuously taken from the return pipe to perform useful work as long as the take off does not exceed what is being compressed by the wave action.

In the event of an impending storm or high seas that might break the moorings or damage the device, it can be taken out of service by simply reducing the take off pressure. This reduces the amount of air volume in the entire stack reducing its buoyancy so that it no longer floats. To restore the stack to normal, air pressure above normal operating pressure can be supplied into the return pipe overcoming sea water pressure as well as check valve pressure thus refloating the stack.

DESCRIPTION OF THE FIGURES

Attention is now called to several drawings which aid in understanding the features of the present invention.

Several illustrations and drawings have been presented to better describe the present invention. The scope of the present invention is not limited to what is shown in the figures.

DETAILED DESCRIPTION OF THE INVENTION

The present invention relates to an ocean wave air compressor. While ocean waves have been described, the present invention can be used on any body of water having wave action. The ocean is generally preferred because of the usually larger size of waves in many areas.

Figure 1:
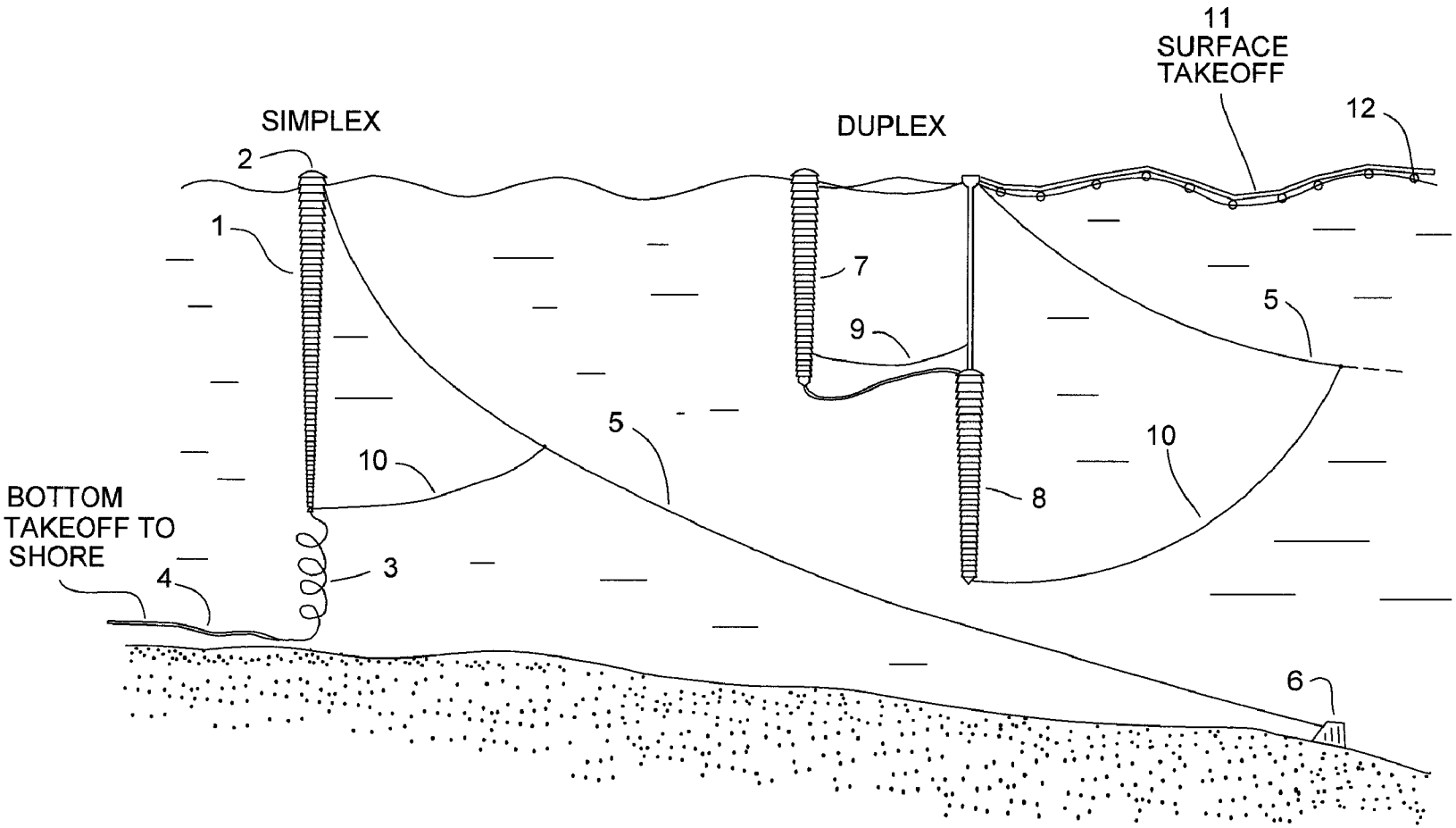
FIG. 1 shows an underwater horizontal view of a simplex and duplex stack arrangement.

Turning to FIG. 1, a horizontal, primarily underwater view can be seen of several embodiments of the present invention. Vertical stacks of cascaded chambers 1, 7, 8 can be seen. Stacks can be either simplex or duplex as shown. Each stack has a top end 2 that floats on the surface of the water. Each stack also has either a take off hose 3, 4 from its bottom end or a surface take off 11 from its top. The take off hoses supply compressed air from the device back to shore or to a floating platform where it can be used to perform work such as running a turbine or where it can be stored. Each stack can be tethered 5 to an anchor point 6 on the bottom. Stabilization lines 10 can secure the bottoms of the stacks. In the case of a bottom take off 4, the hose can be coiled 3 to allow up-down movement of the stack. In the case of a surface takeoff 11, floats 12 can be used to hold the hose on the surface.

As previously stated, the up-down motion of the stacks act to compress air in chambers within each stack level as will be described. The final take off pressure is equivalent to the depth of the lowest chamber. The air temperature of the take off air is approximately that of the surrounding ocean since the generally cold water quickly absorbs any heat generated by compressing causing the device to generally be isothermal. Expansion of the compressed air taken off can provide refrigeration as well as power.

It is well known that air in normal pressure and temperature ranges behaves very closely to an ideal gas. It is also known that for an ideal gas undergoing an isothermal compression, the final pressure over the final volume equals the initial pressure over the initial volume. It is also known that if a container partially containing air is submerged with its bottom open to the sea, the air inside is reduced in volume due to the increasing hydrostatic pressure caused by depth. By the gas law, as the volume decreases, the pressure increases. The applied hydrostatic pressure at any given depth is equal to the density of the fluid times the gravitational constant (generally g at sea level) times the depth. Quite generally, water pressure increases by about 1 atmosphere for every 33 feet increase in depth. Hence, a certain amount of air in such a container at the surface will have approximately ½ the volume and twice the pressure at around 33 feet.

The present invention works on the following principle. A downstroke in a wave trough and an upstroke in a wave crest uses the sea as a piston at different depths to compress air. Due to inertia, mass and depth related buoyancy, vertical travel of an actual stack will be out of phase with the wave undulations, and vertical travel will be less than the wave height profile. These differences allow air to enter the top stages. Each level in the stack has two chambers, an A chamber and a B chamber (it is within the scope of the present invention to have any number of chambers). The chambers are connected at each level by a one-way check valve that allows air to flow from chamber A to chamber B, but not back. Each B chamber is also connected through a one way check valve to the A chamber below it so that air can flow downward, but not upward. On the down stroke, sea water compresses the air in the A chambers. Some of this compressed air passes through the check valves to the corresponding B chambers. On the upstroke, the remaining air in the A chambers expands, but the air that passed into the B chambers cannot return. Thus the final pressure in the A chambers is less than it was when the downstroke started. This causes air to flow into the A chamber from the B chamber above it through the second set of check valves. Air in the final B chamber at the bottom can be taken off through a take off hose or routed upward though the center of the stack in a take off pipe. The final pressure of the compressed air will approximately equal the static water pressure at the depth of the bottom chambers. Actual pressure will also depend on how much air is being drawn off as well as the size of the chambers, the size and frequency of the waves and other factors.

Figure 2:
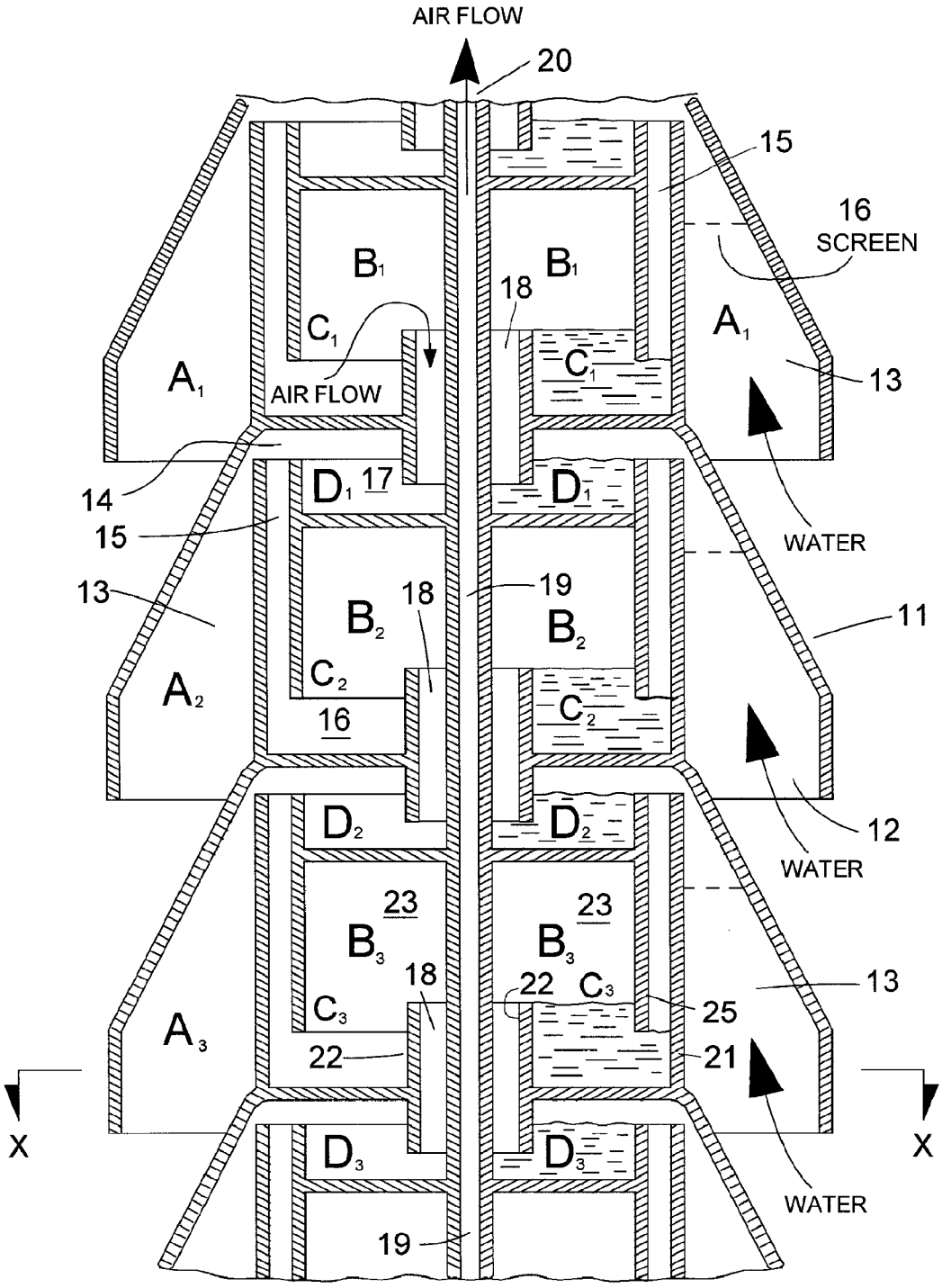
FIG. 2 shows an embodiment of the invention in a downstroke.
Figure 3:
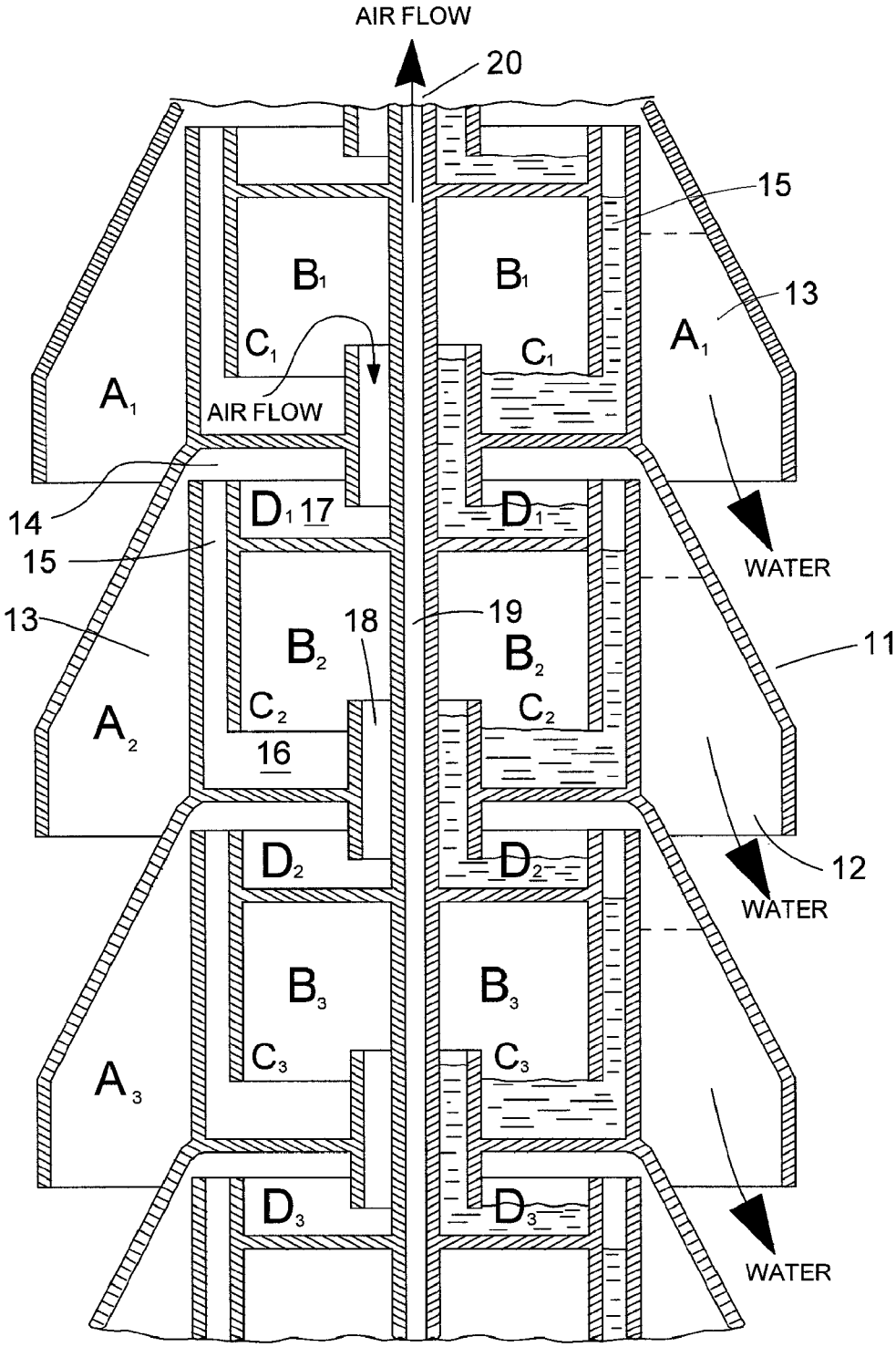
FIG. 3 shows the embodiment of FIG. 2 in an upstroke.

FIG. 2 shows an embodiment of the present invention in a downstroke, while FIG. 3 shows the same embodiment in an upstroke. Each level has a series of A chambers 11 labeled, $A_1$ $A_2$, $A_3$, . . . and a series of B chambers 23 labeled $B_1$, $B_2$, $B_3$, . . . connected by one way water seals $C_1$, $C_2$, $C_3$ . . . from $A_1$->$B_1$, $A_2$->$B_2$, etc. Each B chamber (except the very bottom one) is connected to a second series of one way water seals $D_1$, $D_2$, $D_3$ . . . so that $B_1$->$A_2$, $B_2$->$A_3$, etc. The chambers are shown as cylindrical; however, they can have any shape. A return pipe 19 passes up the center from the lowermost chambers.

Turning to FIG. 2, as a downstroke begins, each A chamber contains an amount of air. As the structure sinks downward, water enters the A chambers 13 from the bottom 12 compressing the air in each A chamber in the stack to a pressure equal to the water pressure at the particular depth. An optional screen 16 in each A chamber allows water and air to pass; however, prevents entry of any debris or foreign objects. As the air in each A chamber compresses, the water seals C allow some of the air to flow through the seal into the corresponding B chamber through the C vertical columns 15. For example, some of the air compressing in chamber $A_n$ flows around the water seal $C_n$ into chamber $B_n$. On the A chamber side, there is a vertical column 15. For air to backflow from $B_n$ into $A_n$, the pressure in $B_n$ would have to be great enough to push all of the $C_n$ water up the vertical column. This cannot happen since when the $B_n$ pressure reaches a certain value it flows through the $D_n$ seal through vertical columns 18 to the top 14 next lower $A_{n+1}$ chamber rather than pushing the water up the $C_n$ column. The D seals have vertical columns 18. The seals are thus designed so that air passing in the desired direction displaces a lesser head of water than would be required for air to pass in the undesired direction. Thus, on the downstroke, air compresses in each A chamber with some of it passing through the C seals into the corresponding B chamber.

FIG. 3 shows the upstroke. As water leaves the A chambers, the air in the A chambers expands. The air in the B chambers cannot return through the C seals, and rather, expands through the D seals into the next lower A chamber when the pressure in that next lower A chamber has been reduced to the point where the B pressure in the chamber above it exceeds it. With each upward and downward movement of the stack, as waves pass, an additional quantity of air moves downward from stage to stage until the final or lowest stage discharges air into the return pipe 19 at a pressure corresponding to the water pressure at the depth of the final stage. This air can be routed upward at about this pressure to be taken off 20 for use. The maximum pressure is approximately the pressure at the depth of the lowest stage.

Figure 4:
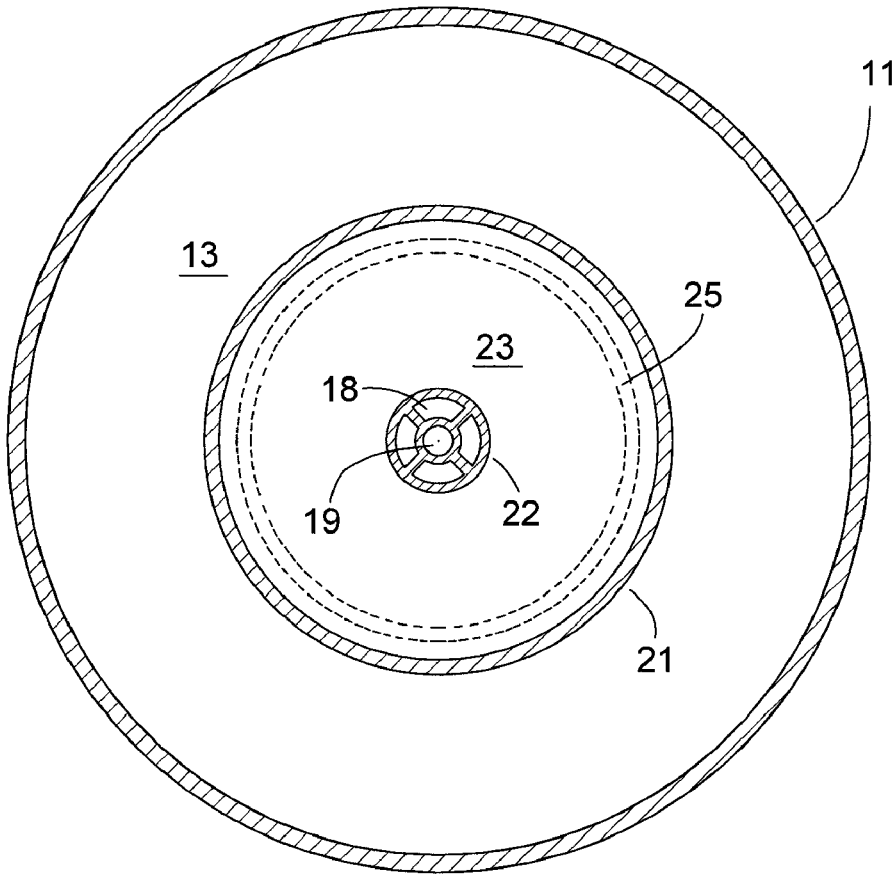
FIG. 4 shows a section of FIG. 2.

A cross section taken at X-X in FIG. 2 or FIG. 3 is shown in FIG. 4. The outer chamber structure 11 can be seen. The A chamber 13 is outermost and surrounds the B chamber which is above it and cannot be seen in the section of FIG. 4. The C chamber is formed between an outer wall 21 and an inner wall 22. The wall of the upper D chamber 25 is above this cross-section and shown in dotted lines. The inner wall 22 of the C chamber is the outer wall of the rising column 18 of the D chamber. The take off pipe 19 is in the center.

Figure 5:
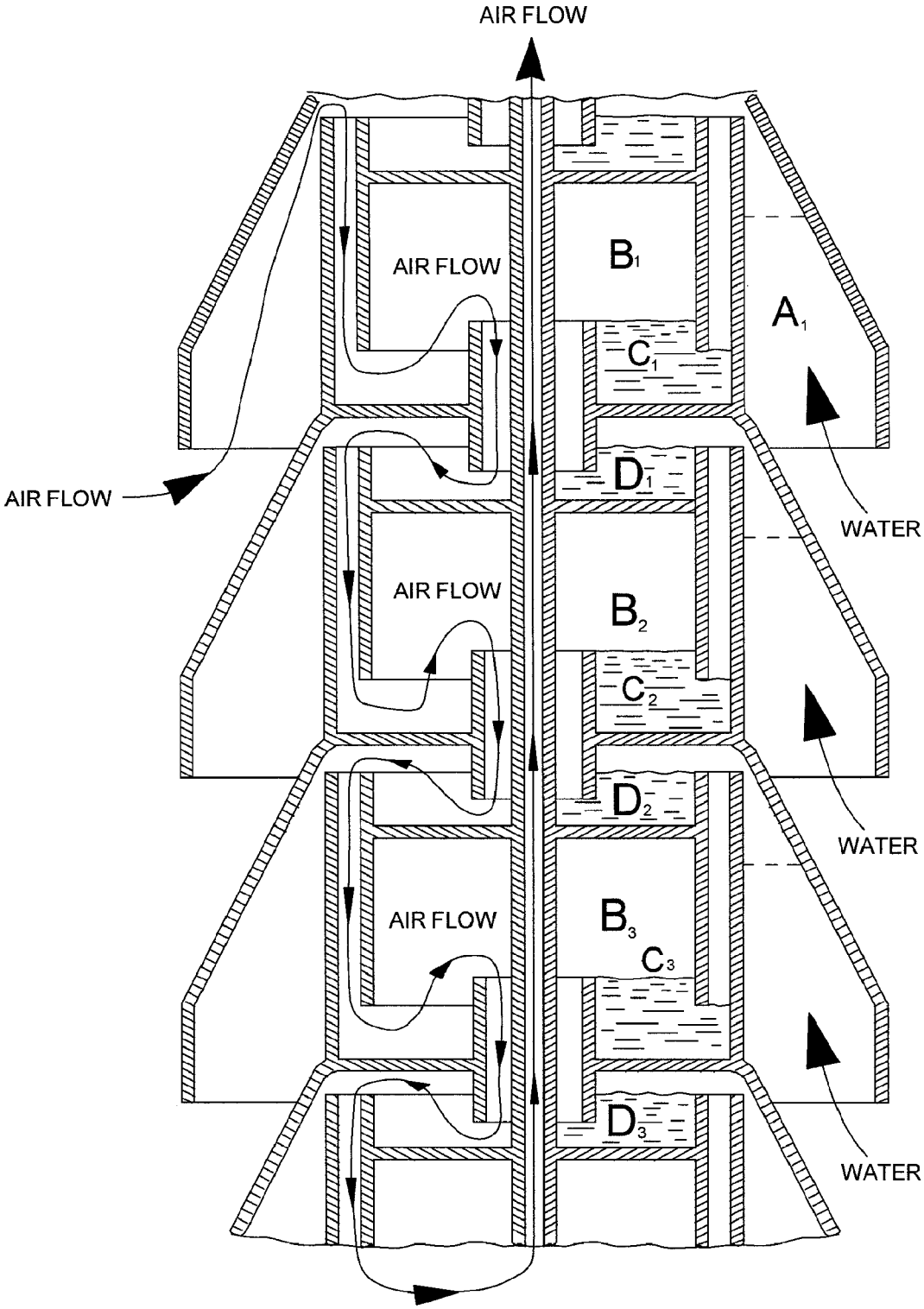
FIG. 5 shows airflow in the embodiment of FIGS. 2-4.

FIG. 5 shows by means of arrows the airflow from the top of the column to the bottom and back up the take off pipe.

Figure 6:
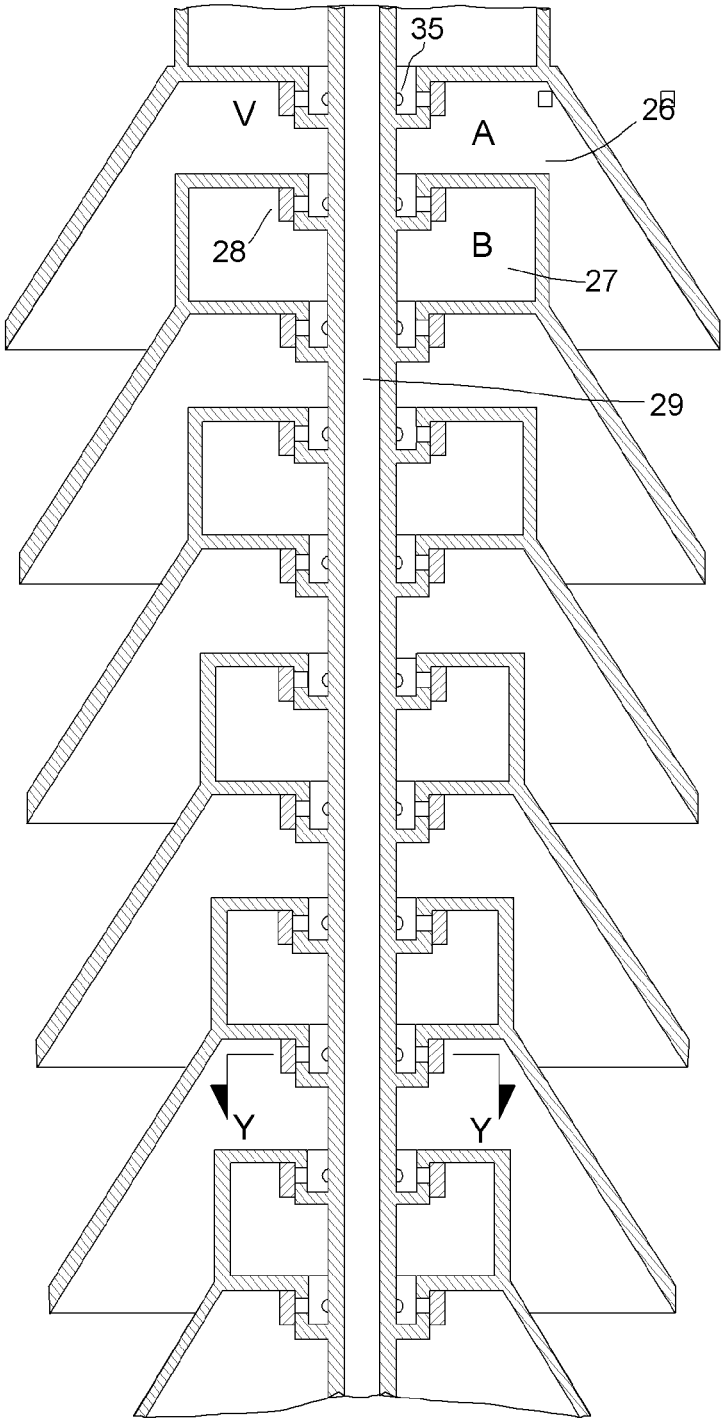
FIG. 6 shows an alternative embodiment of the invention.

FIG. 6 shows an alternate embodiment using mechanical non-return valves rather than water seals with chambers of diminishing volume with depth (to reduce weight of the structure to be lifted). If this type of structure is submerged (say during a storm), a float chamber (not shown) needs to be added to an upper stage and supplied remotely with compressed air to float or control the chamber. This embodiment has A chambers 26 and B chambers 27, as before, with a central return pipe 29. Identical mechanical check valves 28 can be used at each level. A hole 35 aligns with a port 33 (FIG. 7) in check valve 28.

Figure 7:
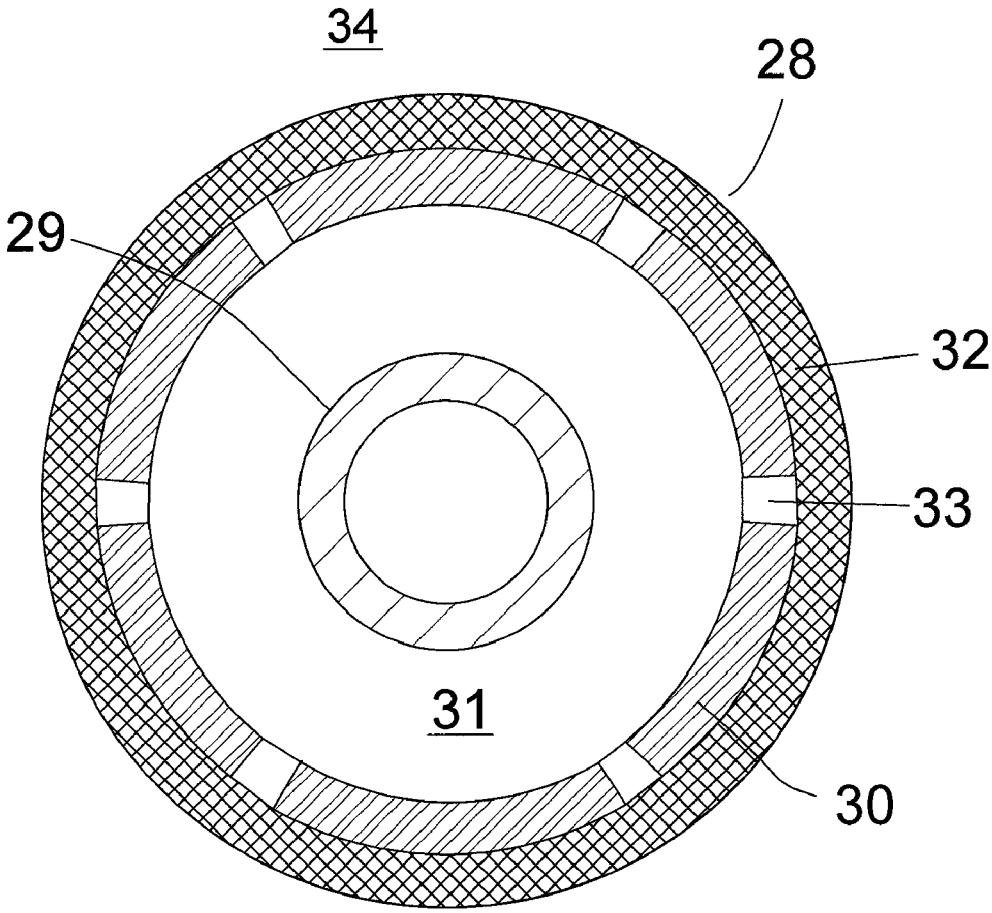
FIG. 7 shows a section of FIG. 6

FIG. 7 is a cross section at Y-Y from FIG. 6 showing a rubber band valve 28 with ports 33 that open and close as the structure rises and falls subsequently allowing air from the A chamber to move to the B chamber and then from the B chamber to the next lower A chamber. The central pipe 29 is surrounded by a solid region 30 with ports 33. A rubber band 32 surrounds the solid region 30. The rubber band 32 will expand to allow air to escape outward though the ports 33, but will not allow air to flow inward through the ports 33. The region 31 belongs to the A or B chamber above, while the region 34 belongs to the A or B chamber below. The functioning is as follows: If holes are placed in a tube with a closed end, and the holes are covered with a rubber band or strap, air being forced into the tube will escape through the holes by expanding the rubber band. However, if the pressure is lowered in the tube, air cannot come in through the holes because the rubber band holds the holes closed. While, this type of check valve and previously a water seal have been used to allow forward (downward) flow of air, but not reverse flow (upward), any type of one-way valve can be used and is within the scope of the present invention.

While specific embodiments show a particular number of chambers, or particular shapes and/or sizes of chambers and valves, any number of chambers, based on chamber size and available depth may be used. Also, any shape or size of chamber may be used. The apparatus may be simplex, duplex as shown in FIG. 1, or have more than two parts. Any number of parts in tandem is within the scope of the present invention.

An example of an application of the present invention is as follows: In a typical deep sea application, with 9 foot waves having a period of 8 seconds, an embodiment of the present invention with a 10 foot diameter initial stage that rises and falls 2 feet with each passing wave would have a terminal pressure of 3 atmospheres and an approximate horse power of 75 (55950 watts). These numbers are for example only and are approximate.

As previously stated, the present invention can be used to provide refrigeration since the temperature of the compressed air taken off is approximately that of the surrounding water. If this air is expanded as is known in the art, the resulting temperature drop will provide refrigeration. One way to provide expansion with a drop in temperature is through a valve, throttling device or other mechanism that allows a reduction of pressure in a controlled volume. Also, venting compressed air through a nozzle or venturi at a particular flow rate (where velocity increases) causes a drop in temperature. Given enough pressure, and depending on the water temperature, the exhaust can be below freezing.

Several descriptions and illustrations have been provided to aid in understanding the present invention. One skilled in the art will realize that numerous changes and variations are possible without departing from the spirit of the invention. Each of these changes and variations is within the scope of the present invention.

I claim:

1. A wave-driven air compressor comprising: a plurality of chamber sections stacked vertically, each chamber section having an A chamber and a B chamber, wherein each A chamber is downwardly open to water; each chamber section also having a one way air valve between the A chamber and the B chamber; each chamber section except a bottom section also having a one-way air valve between the B chamber and an A chamber in a section below; a bottom section having a one-way valve between the B chamber and a take off pipe or hose; whereby, when said chamber sections rise and fall with waves, air becomes compressed at each section to a pressure higher than a section above, and compressed air can be taken off through said take off pipe or hose.

2. The wave-driven air compressor of claim 1 wherein said chambers are cylindrical.

3. The wave-driven air compressor of claim 1 wherein said one-way valves are water seals.

4. The wave-driven air compressor of claim 1 wherein said one-way valves are rubber band valves.

5. The wave-driven air compressor of claim 1 further comprising a screen at a water entry point.

6. The wave-driven air compressor of claim 1 further comprising a duplex arrangement wherein a first stack of said chamber sections with a top and bottom chamber section floats on the water surface and a second stack of chamber sections also with a top and bottom chamber section floats at a level deeper than the bottom chamber section of said first stack, the bottom B chamber of said first stack being coupled to the top A chamber of said second stack with a pipe or hose so that compressed air can flow from the first stack to the second stack.

7. The wave-driven air compressor of claim 1 wherein each successively deeper chamber section in said stack has a smaller diameter.

8. The wave-driven air compressor of claim 1 wherein said stack can be submerged by reducing pressure at said take off.

9. The wave-driven air compressor of claim 8 wherein said stack can be re-floated by pumping air into said take off.

10. The wave driven air compressor of claim 1 wherein said B chambers are contained concentrically within said A chambers.

11. An ocean wave air compressor comprising a vertical stack of inverted cup-like chamber sections, each chamber section having at least first and second internal chambers air coupled to each other from the first chamber to the second chamber with a one-way check valve, each of said first chambers being downwardly open to the sea, and each of said second chambers being air coupled vertically with a one-way check valve to a first chamber immediately below it, except a bottom-most second chamber being coupled to an air take-off.

12. The ocean wave air compressor of claim 11 wherein said second chambers are contained concentrically within said first chambers.

13. The ocean wave air compressor of claim 11 wherein said one-way check valves are water seals.

14. The ocean wave air compressor of claim 11 wherein said one-way check valves are rubber band valves.

15. The ocean wave air compressor of claim 11 wherein each successively deeper chamber section in said stack has a smaller diameter.

16. The ocean wave air compressor of claim 11 wherein said stack can be totally submerged for protection by reducing pressure in said air take-off.

17. The ocean wave air compressor of claim 16 wherein said stack can be re-floated by externally increasing pressure in said air take-off.

18. The ocean wave air compressor of claim 11 further comprising a duplex arrangement wherein a first stack of said chamber sections with a top and bottom chamber section floats on the water surface and a second stack of chamber sections also with a top and bottom chamber section floats at a level deeper than the bottom chamber section of said first stack, the bottom second chamber of said first stack being coupled to the top first chamber of said second stack with a pipe or hose so that compressed air can flow from the first stack to the second stack.

19. The ocean wave air compressor of claim 11 wherein compressed air from said air take-off is further expanded to produce refrigeration.

20. A floating water wave-driven power generating device comprising a plurality of compression stages stacked vertically from surface to a predetermined depth; each compression stage having an outer chamber containing air downwardly open to the water and a concentric inner chamber also containing air not open to the water, the outer chamber being air coupled to the inner chamber with a first one-wave valve, and wherein, on a downward stroke, entering water compresses air in said outer chamber forcing a portion of said air through said first one-wave valve into said inner chamber compressing air within said inner chamber; and wherein said inner chamber is coupled to the outer chamber of the next lower stage through a second one-way valve, and wherein, on an upstroke, leaving water reduces pressure in said outer chamber of said next lower stage so that air flows from said inner chamber into said outer chamber of said next lower stage; and wherein the bottom-most inner chamber is connected to a take off which can carry compressed air away from said device.

* * * * *